United States Patent [19]

Bucher

[11] 4,118,908

[45] Oct. 10, 1978

[54] SPIRAL STAIRCASE

[76] Inventor: Adolf Bucher, Obere Raumuhle 1, D-7035 Waldenbuch, Germany

[21] Appl. No.: 747,813

[22] Filed: Dec. 6, 1976

[30] Foreign Application Priority Data

Dec. 6, 1975 [DE] Fed. Rep. of Germany ..... 2555041

[51] Int. Cl.[2] ..... E04F 11/02; E04F 11/18

[52] U.S. Cl. ..... 52/185; 52/187; 403/8; 403/231

[58] Field of Search ..... 256/65, DIG. 6; 403/8, 403/231, 286, 403; 52/185, 187

[56] References Cited

U.S. PATENT DOCUMENTS

| | | | |
|---|---|---|---|
| 313,193 | 3/1885 | Gaylord | 403/8 |
| 1,335,554 | 3/1920 | Callahan | 403/8 |
| 1,346,518 | 7/1920 | Waggoner | 403/8 X |
| 3,328,056 | 6/1967 | Hecken | 403/403 X |

FOREIGN PATENT DOCUMENTS

| | | | |
|---|---|---|---|
| 2,149,096 | 4/1973 | Fed. Rep. of Germany | 52/187 |
| 2,332,806 | 1/1975 | Fed. Rep. of Germany | 52/187 |
| 394,429 | 6/1933 | United Kingdom | 403/231 |

*Primary Examiner*—Alfred C. Perham
*Attorney, Agent, or Firm*—Shlesinger, Arkwright, Garvey & Dinsmore

[57] ABSTRACT

A spiral staircase having at least one straight section and at least one curved section wherein the steps are supported at one end thereof on a wall and at the other end are suspended from a handrail and wherein the handrail is formed from straight sections having a substantially uniform height above the steps.

6 Claims, 11 Drawing Figures

SPIRAL STAIRCASE

The invention deals with a spiral staircase with at least one straight and one spiral section, preferably of wood, whose steps are supported on the one end directly on the wall of the stairway enclosure and on the other end suspended in the area of the staircase opening by means of two landing posts on a handrail connected with entrance and exit posts in the floor levels, whereby each landing post connects to a step in the area of its leading edge and the next lower step in the area of the rear edge.

Such a single-tracked stairway construction is advantageously suitable for a space-conserving arrangement, for example, if the entrance and exit to the floor levels occur with sections proceeding straight and a half spiral is provided as a connection piece. However, the invention also applied where a straight section is provided between two quarter turns or where spiral staircases extend across other arched angles than 90° or 180° in adaptation to existing installation possibilities, or with quarter spirals which are single tracked at the entrance or exit.

In the curved stairways previously known including one or more quarter spirals, the handrail adjusted to the stairway slope always forms a curved line in the spiraling. Such handrails are difficult to manufacture and therefore expensive since they require in the manufacturing what is known in the technical language as a "curved" (handrail), i.e. a two-dimensional curved handrail. This results from the fact that with a spiral staircase which shows straight and curved sections the distance from one leading edge to the other are unequal; however, on the other hand, the height of the railing above each step leading edge should always remain the same when considering good passability of the spiral staircase as well as the legal and technical construction requirements.

If the above legal requirements of sufficient and uniform height distance of the handrail from each step leading edge are disregarded, in order to apply with curved steps a handrail with equal ascent in the curving or even a completely straight handrail, the good passability of the stairway in the area of the spiraling would be thereby impaired and namely, because of the uneven height of the railing, apart from the uneven, impermissable distances and lengths of the steps.

A further disadvantage results from the uneven intervals between consecutive leading edges with spiral staircases of the kind named above, namely, that also the intervals between the landing posts, with which the steps are supported on the hand railing, have differences which are explained out of the adjustment of the steps out of the spiraling into the straight stairway section. These uneven landing post intervals are not only unsuitable for a stairway construction from the viewpoint of design but also cause accidents for children because the physically necessary safety intervals cannot be observed everywhere.

It is the purpose of the invention to construct a stairway with the construction indicated above so that the mentioned disadvantage of uneven railing rise (slope), the manufacture of railing curvatures and of the unequal landing spoke differences can be eliminated and simultaneously the manufacturing and installation of the staircases including the railing can be simplified and made cheaper.

According to the basic idea of the invention this task is solved in that the handrail, done in even slope in its winding in the spiral area between the entrance and exit posts, consists from the top-plan view out of angles, preferably rectangular sections connected to one another, and that for the purpose of achieving a uniform rail height above the steps, the intervals between the step leading edges above the spiral stairway area as well as on a progress line (construction line) running across the step centers as well as on the handrail center determining the securing of the landing spokes are equally divided up.

Preferably, the steps overlap each other, whereby the center line of each overlap corresponds to the point of intersection of the hand rail center line and the suspension point of a landing spoke. On the basis of these measures the steps suspended on the outer side of the stairway are equally wide in this area so that the pointed steps otherwise present in the spiraling can be avoided. In addition, to this known advantage from the step adjustment, the invention achieves above all that the distances between the railing spokes which bear the steps are equalized, which is visually pleasant and also considers safety regulations, and that the handrail may be manufactured in a very simple way out of a straight equally wide plank. Thereby instead of a curved handrail, in top-plan view, an angular relationship of the handrail sections is achieved, which easily satisfies aesthetic requirements.

According to a further characteristic of the invention, the distances between spokes, at least within the handrail sections, are equal with one another.

The lateral distance between two successive spokes which are suspended from different handrail sections as in the area of the handrail angle, corresponds approximately to one half of a length on the handrail center line, when viewed from above, between the point of intersection of an arc having as its radius the regular distance around the center of the last one of these consecutive spokes with the handrail center line and the end of the regular distance from the same spoke center as developed on the handrail center line around the apex of the angle.

According to a further essential characteristic of the invention, the ends facing each other of the handrail sections touching one another angularly are manufactured from a straight plank by a saw cut made vertically in the plank while at its slope angle, the length of which vertical sawcut is decreased by the thickness of the plank and which is run in a right angle outward through the plank. In consideration of this suggestion, the handrailings or the handrail sections for one-quarter, two-quarter or half-spiral staircases can be manufactured from one piece of plank without cut-offs, respectively, waste, by forming the spiral in the handrail as a break of angle and applying corresponding saw-cuts in the plank used for maufacturing. The hand rails formed by the saw-cut described above can be directly joined to each other with each running of the handrail, also with the preferred 90° angles handrail whereby that handrail section, when viewed in top-plan view, "runs through" with the mounting for the landing spokes hanging which is nearer to its (mounting) end, while the other handrail section is mounted sideways with its saw-cut surface. In this way enough material remains on this connecting handrail section up to the successive landing spoke installation in order to be able to place the screws for the connection of the handrail sections without problem.

According to a further characteristic of this invention, the entrance and exit posts can likewise be manufactured from the same plank, respectively, from the piece of plank containing at least the connecting handrail section so that the piece of plank on the end of the handrail is divided by a saw-cut halving the slope angle and both construction parts are screwed into each other after turning of the post by 180° around the longitudinal axis at an oblique angle. Also on the basis of this characteristic, considerable savings in material and working time can be achieved.

DESCRIPTION OF THE DRAWINGS

The invention is subsequently explained in more detail by means of exemplary embodiments with further characteristics and advantages in the illustrations.

DESCRIPTION OF THE INVENTION

Figure 1:
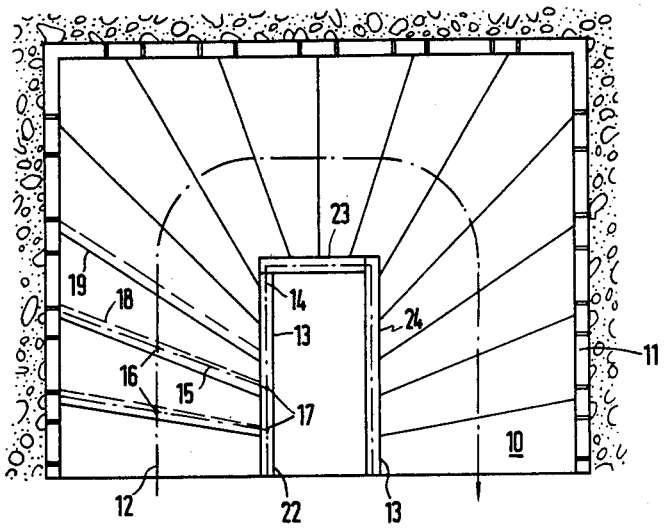
FIG. 1 is a schematic top-plan view of a one-tracked, two-quartered spiral stairway according to the invention with steps suspended on the handrail lying inside.

In the exemplary embodiment according to FIG. 1, the staircase which runs between two floor levels is placed within a rectangular staircase space enclosure whereby the wall side support can be effected, for instance, by means of bolts proceeding from the steps and housed in elastic bearing cages in the wall or also in a conventional side wall, or something and whereby this support on the wall side of the steps 10 is indicated by the reference 11. The number of steps is calculated in a known way from a given value of the spacing between two floors and the value of the slope of the staircase based on the available floor space, whereby equal intervals corresponding to the number of steps are entered on the progress line 12. As further construction basis the handrail 13 is present in a path which is bent twice at an angle of 90°. The handrail center line 14 forms a further construction basis in addition to the progress line 12. The handrail center line 14 is also subdivided, as the progress line 12, into equal intervals corresponding to the number of steps.

The connection lines 15 between the points 16, or 17 registered on the construction lines 12 and 14 form auxiliary lines, which correspond to the center of the overlap between the rear edge 18 of a step and the leading edge 19 of the step above. The size of the overlap is so chosen that the landing spokes 20 corresponding to FIG. 9 proceeding from the underside of the handrail 14 connect to the steps at a point spaced from the leading edge of the upper step and the rear edge of the step lying below. The type of fastening of the landing spokes 20 in the handrail and of the connection onto the steps as well as the indicated spacer 21 can be of any kind and does not comprise a part of this invention.

Figures 2A, 2B:
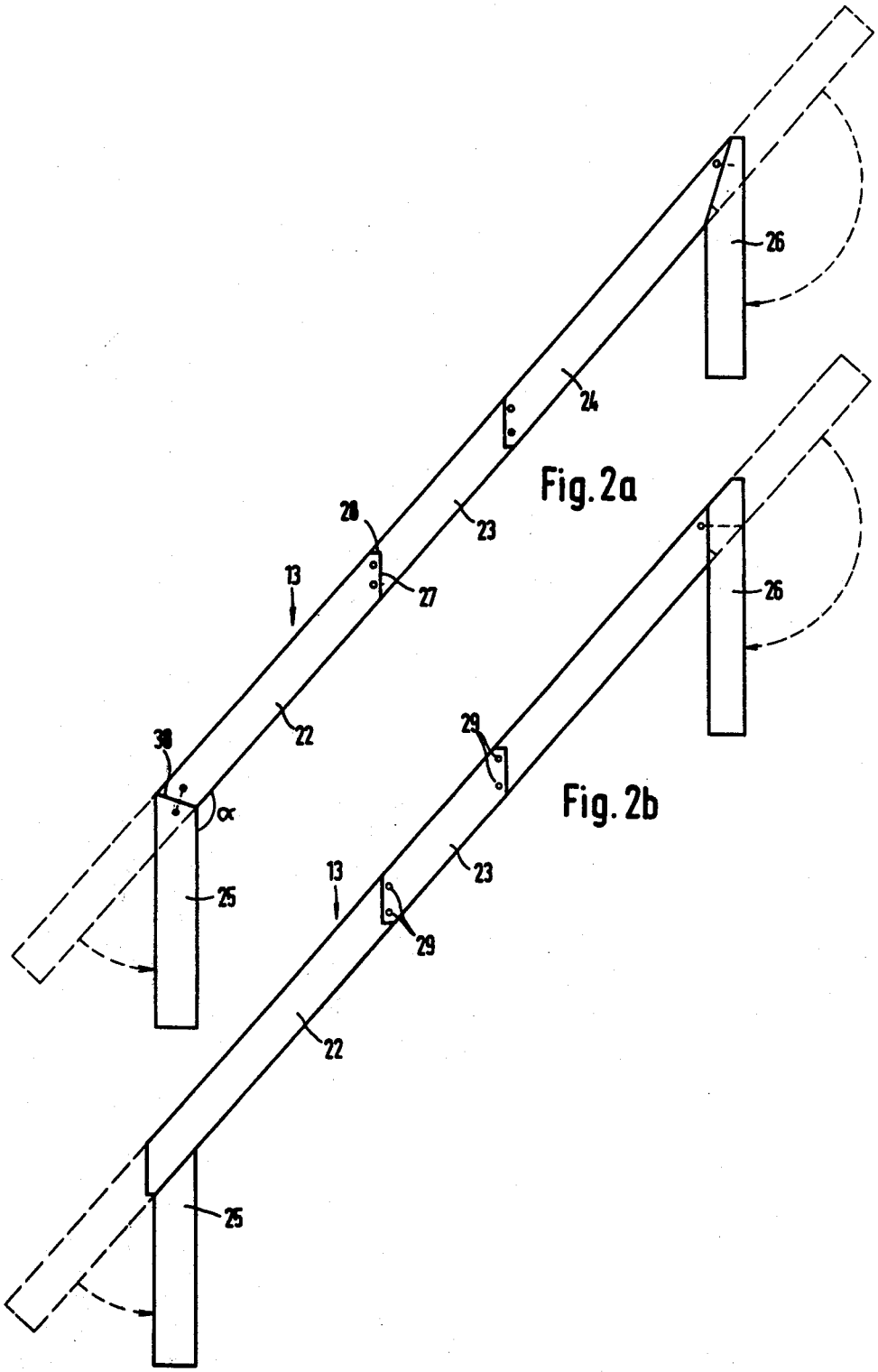
FIGS. 2*a* and 2*b* are diagrams of the handrail for the stairway according to FIG. 1 in the winding without attached steps.

The handrail shown in FIG. 2*a*, 2*b* in the winding consists of handrail section 22, 23, 24 and the entrance posts 25 as well as the exit posts 26. The three handrail sections are manufactured by the butting of two saw-cuts from the same plank. Each saw-cut consists of a vertical section 27 and a horizontal section 28 corresponding to the thickness of the plank. The kind of cutting depends on how the handrail sections are to be connected to each other. According to FIGS. 1 and 2*a* the handrail part 23 and the handrail parts 22 and 24 are connected obliquely and screwed together as shown at their saw-cut surfaces. According to FIG. 2*b* the handrail section 23 runs through so that the screws 29 can all be inserted from the same side.

Figure 3A:
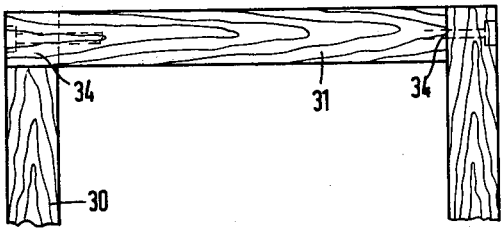
FIGS. 3*a* and 3*b* are a schematic top-plan view and an exploded side elevation view of handrail sections to be connected with each other.
Figure 3B:
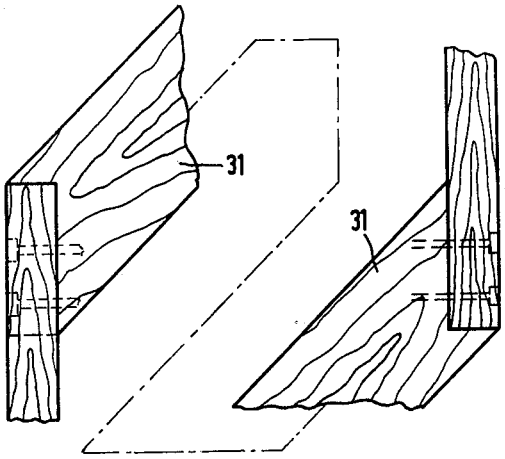

This type of connection is not binding, buts results appropriately from the consideration that sufficient space must be left in the handrail section which receives the screws up to the next reception for the landing post 20. FIGS. 3*a*, 3*b* show a variation where the lower handrail section 30 is notched out and the center handrail section 31 runs into the notch in section 30 and is also notched out at its higher end and is there screwed together with the upper handrail part 32 which runs into the notch in section 31 so that the screws 34 at both ends of the center handrail section are not parallel as in FIG. 2*a*, but are perpendicular.

Figure 4:
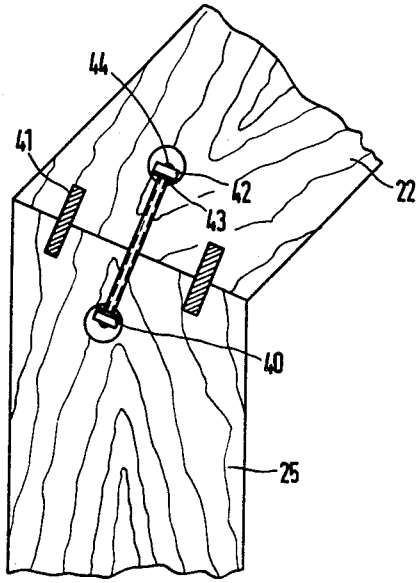
FIG. 4 is a schematic view of a connection between entrance posts and handrail.

The connection entrance posts handrail with the details shown in FIG. 4 corresponds to the construction parts 25, 22 in FIG. 2. The construction parts can be adjusted to each other and connected by a screw bolt 40 and plug 41, whereby the nuts 42 and washers 43 may be tightened in the cross-bores. The variations according to FIG. 5 show a handrail section 51, which lies on the cutting surface of the entrance post 50, especially with a steep handrail.

Figure 5:
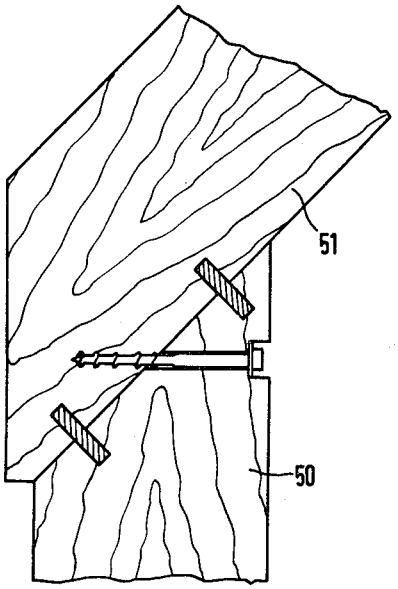
FIG. 5 is a variation of the connection according to FIG. 4.
Figure 6:
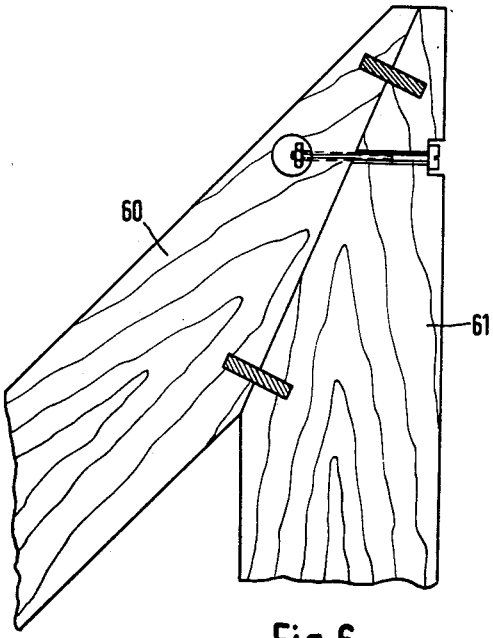
FIG. 6 is a view of a connection between handrail and exit posts.
Figure 7:
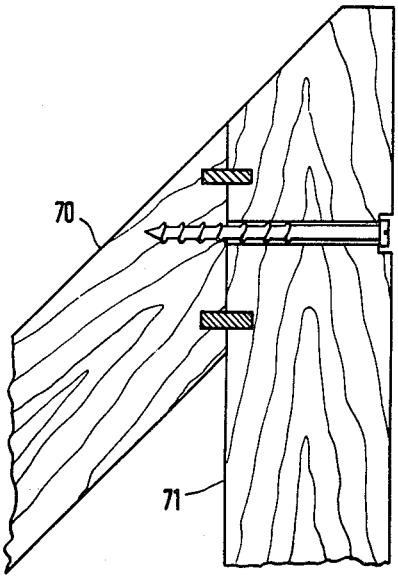
FIG. 7 is a variation of the connection according to FIG. 6.

Analogous to the connections according to FIGS. 4 and 5, the handrail section 60, respectively 70, in accordance with FIGS. 6 and 7, are also connected to the respective exit posts 61, 71, whereby, however, according to FIG. 7, the cutting surface of the handrail section 70 butts against the longitudinal side of the exit post 71 and is screwed and plugged in there.

Figure 8:
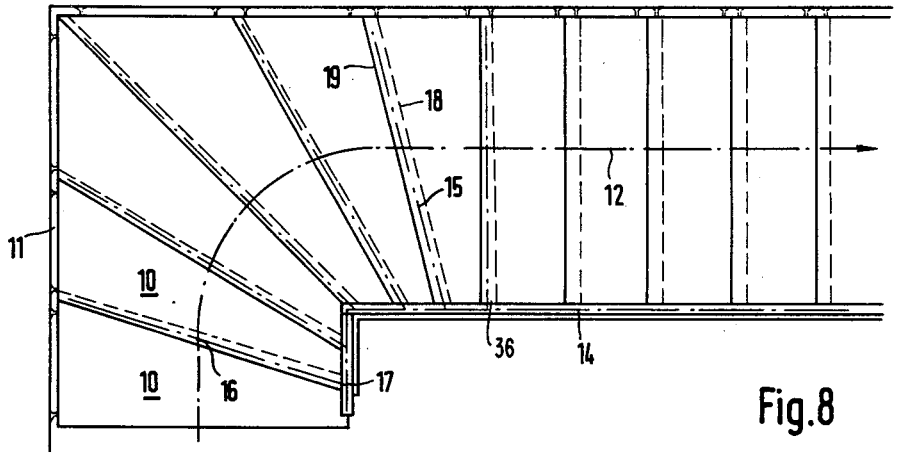
FIGS. 8 and 9 are a top plan view and a said elevation view respectively of a one-tracked, one quarter spiraled stairway at the entrance according to the invention.
Figure 9:
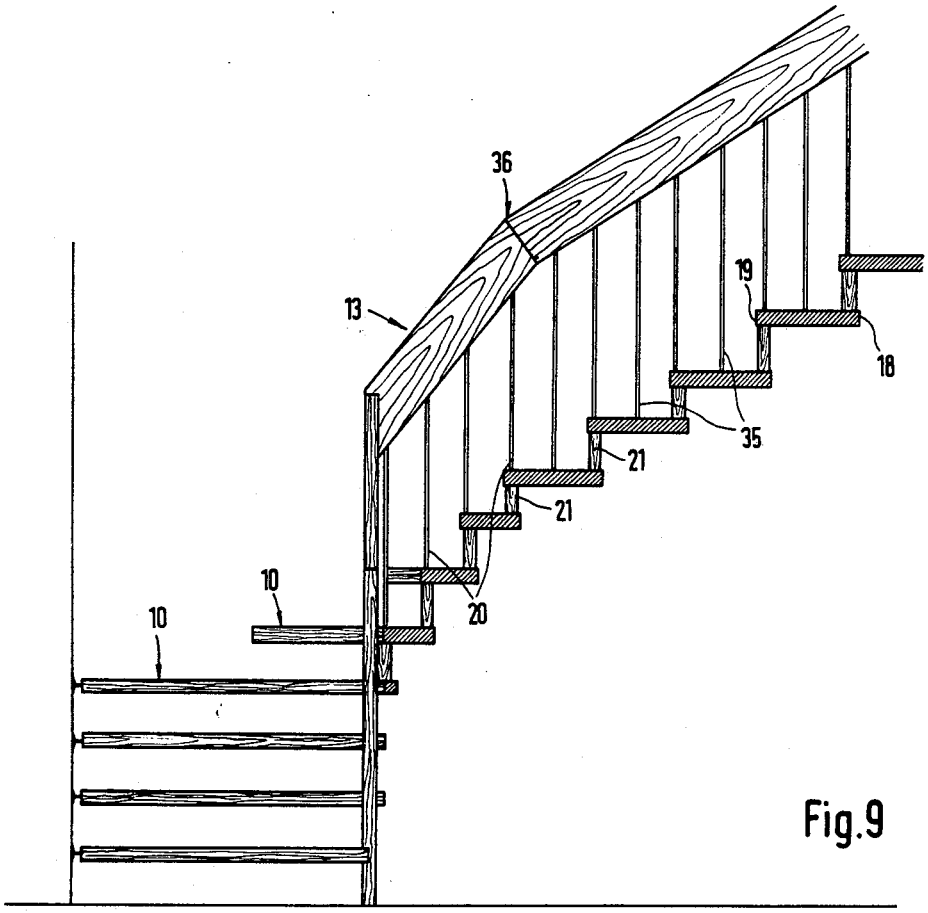

Corresponding to FIGS. 8 and 9, the invention is illustrated with a one-tracked staircase one-quarter spiraled at the entrance in order to also emphasize the advantage with this mixed type. In the spiraled entrance area the arrangement of the steps proceeds up to the point where the step width on the handrail center line 14 corresponds to half the value of the widths of the steps in the straight area of the staircase. In this way equal distance will be achieved by inserting intermediate spokes 35 between the landing spokes 20 in the straight stairway area altogether.

In adaptation to the staircase rise, also, the handrail 13 has a greater slope at the lever, entrance portion up to the end of the spiral at the position 36 than at the upper exit portion above point 36.

The handrail connection at 36 (FIG. 8) is again achieved by simple saw-cut through the plank from which all handrail section are preferably prepared, and the saw-cut is made through the plank in a direction corresponding to half of the angle between both handrail sections.

What I claim is:

1. In a spiral staircase having at least one spiral section between two consecutive floor levels comprising a plurality of steps each having a leading edge and a rear edge and each being supported at its outer end at a wall adjacent said staircase, a handrail formed of rectangularly related sections, when viewed from above, and including support posts at the upper and lower ends of said staircase for supporting said handrail on the respective floor levels, a plurality of spokes for suspending the inner ends of said steps from said handrail, said spokes being arranged so that there is provided one spoke for each step, and each spoke suspending one step adjacent its leading edge and the next deeper step adjacent its rear edge, the improvement comprising said plurality of steps being splayed such, that the distance between the midpoints of adjacent leading edges, when viewed from above, being equal along said staircase and that the distances between successive vertical lines connecting one of said leading edges and the center line of said handrail, being substantially equal along said staircase, said spokes being equally spaced along the staircase, said handrail between said upper and lower support posts having a constant slope and continuing over the rectangularly connected handrail sections such that the vertical distances between the handrail and the leading edges of said plurality of steps remains equal along said staircase.

2. A spiral staircase according to claim 1, wherein the leading edge of each step overlaps the rear edge of each next deeper step and wherein the point of intersection between the centerline of every overlap with the handrail centerline, when seen from above, corresponds substantially to the center of a spoke from said handrail.

3. Spiral staircase according to claim 1, in which the lateral distance between two successive spokes, which are suspended from different handrail sections in the area of the handrail angle, corresponds approximately to the half of a length on said handrail centerline, when seen from above, between the point of intersection of an arc, having as radius the regular distance, around the center of the last one of said successive spokes with said handrail centerline, and the end of said regular distance, from the same spoke center, as developed on said centerline around the angle apex.

4. Spiral staircase according to claim 1, wherein substantially all of said handrail sections are manufactured from one straight plank in such a way that for each connection a longer saw-cut is made through said plank and is directed vertically to the slope angle of the handrail, the length of said vertical saw-cut being reduced by the thickness of the plank, and a shorter horizontal saw-cut being made continuing to the outside of the plank and said handrail sections being screwed to each other at their ends, the slope angle of the handrail being continued over the angle points therein.

5. Spiral staircase according to claim 4, wherein said support posts are cut from said plank so that the piece of plank on the end of the handrail is divided by a saw-cut halving the slope angle, or the complementary angle and both construction parts are screwed together after rotation of the posts by 180° around the longitudinal axis at an oblique angle.

6. In a spiral staircase having one spiral section and one straight section between two consecutive floor levels, comprising a plurality of steps each having a leading edge and a rear edge and each being supported at its outer end at a wall adjacent to said staircases, a handrail formed of rectangularly related sections, when viewed from above, and including support posts at the upper and lower ends of said staircase for supporting said handrail on the respective floor levels, a first plurality of spokes for suspending the inner ends of said steps from said handrail, said spokes being arranged so that there is provided one spoke for each step, and each spoke suspending one step adjacent its leading edge and the next deeper step adjacent its rear edge, the improvement comprising said steps of said spiral section and a portion of said straight section are splayed in a manner that the distance between successive leading edges, when viewed from above, is half as long as the distance between successive leading edge in the remaining portion of the straight section, a second plurality of spokes for suspending the steps in said remaining portion of said straight section each at a point midway between two successive spokes simultaneously suspending the leading edge of one step and the rear edge of the next deeper step, said handrail being arranged at equal vertical distance to each leading edge and having constant slope angles each in the remaining portion of the straight section and in the section of splayed steps.

* * * * *